US005922211A

United States Patent [19]

Nees

[11] Patent Number: 5,922,211

[45] Date of Patent: Jul. 13, 1999

[54] METHOD FOR CENTRIFUGAL PARTICLE SEPARATION, PARTICULARLY FOR USE IN THE BIOLOGICAL SECTOR

[76] Inventor: Stephan Nees, Waldwiesenstrasse 30b, Munich, Germany, D-81375

[21] Appl. No.: 08/827,064

[22] Filed: Mar. 26, 1997

[30] Foreign Application Priority Data

Mar. 26, 1996 [DE] Germany ..... 196 11 940

[51] Int. Cl.[6] ..... B04B 5/02

[52] U.S. Cl. ..... 210/781; 210/782; 210/787; 210/805; 422/72; 422/101; 436/45; 494/37

[58] Field of Search ..... 210/781, 782, 210/787, 808, 360.1; 422/72; 436/45; 494/28.3

[56] References Cited

U.S. PATENT DOCUMENTS 4,648,863 3/1987 Nees ..... 422/75
5,663,051 9/1997 Vlasselaer ..... 210/782

*Primary Examiner*—David A. Reifsnyder
*Attorney, Agent, or Firm*—Jacobson, Price, Holman & Stern, PLLC

[57] ABSTRACT

The invention relates to a method for centrifugal particle separation, particularly in the biological sector, wherein a sample (26) to be fractionated is introduced into a centrifuge vessel (1) via a cannula (5), the free end (51) of which extends to point (1') of a centrifuge vessel (1) which sharply tapers toward tip (1') to minimize the undesirable effects of the Coriolis force, with a gradient solution (7) having a density that increases continuously or step by step then being introduced via cannula (5), with particles from sample (26) migrating due to the action of equilibrium and/or sedimentation centrifugation into gradient solution (7), and with a pressure fluid being introduced into the interior of sealed centrifuge vessel (1) via an additional cannula (17) after a predetermined centrifugation period to expel gradient solution (7) containing the fractionated particles of sample (26) via cannula (5).

7 Claims, 3 Drawing Sheets

METHOD FOR CENTRIFUGAL PARTICLE SEPARATION, PARTICULARLY FOR USE IN THE BIOLOGICAL SECTOR

BACKGROUND OF THE INVENTION

The invention relates to a method for centrifugal particle separation.

Research in the area of organ functions on the cellular level has enormously expanded during the past years. Basic physiological research today centers on describing specific functions of the differentiated and specialized cell types which form the individual tissue types and which, in combination, are ultimately responsible for performing the central tasks of the body's organs.

The primary precondition for the further development of this important direction in research is the availability of ever more efficient cell separation methods. Today, immunological separation techniques seem to be very promising for this purpose. They are always based on the expression of typical cellular antigens which are identified by means of highly specific antibodies and ultimately used for separation. Anchoring the antibodies to magnetic particles, for example, can cause the cells, through these proteins, to be bound to the particles as well. In the ideal case, this process can be used in an attractively simple manner to separate the bound cells by means of a magnet.

However, cell-specific antibodies are often extremely species-specific (and therefore frequently unavailable) and furthermore very costly. In addition to these limitations, which in practice are often decisive, the analizability of antigen structures for successful cell separation quickly meets insurmountable obstacles whenever it is to be used for separating cell types that are initially tightly bonded together within tissue types—in contrast to blood cells, for instance, which are present in a physiological suspension.

Thus, the first and foremost prerequisite is the complete dissociation and suspension of such cells from their union with the native tissue. This can be achieved only by the action of complex proteolytic mixtures which are apt in their attack to change substantially and unavoidably the antigen pattern of the tissue cells. Antigens which are frequently detached or masked or even newly developed or expressed in a non-specific manner during proteolysis soon make the subsequent immunological separation technique inefficient. Numerous foreign cells will typically creep into the final suspension of the "purified" target cell type. As a result, there is currently a surge of false announcements in the technical literature.

Certain physical or physical-chemical cell characteristics survive the action of proteolytic enzymes substantially more reliably than immunologically identifiable cell properties. This includes on the one hand size, form and aggregability of the cells and on the other hand their specific weight which, under given physiological conditions, substantially depends on the ion and water permeability of the cell membranes or the osmotic pressure present within the cells. Each of these physical or physical-chemical quantities can be used as a separation parameter for a successful cell separation if the cells are exposed to the gravitational field of a suitable centrifuge. Customarily, cell separation in centrifuge vessels takes place in liquid media of a certain density which are layered as so-called "discontinuous or continuous density gradients." The first task of these media is to stabilize the intended cell separation against thermal convection and mechanical vibration. The sedimentation rate v depends on the interrelationship expressed by the following formula:

$$v = \frac{d^2(\delta_Z - \delta_M)}{18\mu} \cdot \omega^2 \cdot r$$

where d is the cell radius, $\delta_Z$ and $\delta_M$ the specific density of the cells and the medium, respectively, $\mu$ the viscosity of the separation medium, ω the angular velocity and r the rotor radius.

On this basis, the following two techniques, which in principle can be selected at will but cannot be combined with complete consistency, are currently practiced in centrifugation processes:

1. "Zonal Centrifugation"

Here, the cells are separated in a gradient of the selected separation medium which becomes increasingly dense in sedimentation direction but is nevertheless relatively shallow and continuous or formed in steps (various products are available on the market, for example, Ficoll, Metrizamide, Percoll, etc.), such that none of the cell types can find an isopycnic density range (one which corresponds to its own specific density). As a result, all cell types would collect again on the bottom of the separation vessel if centrifugation were not interrupted at the appropriate time. Separation occurs primarily based on the different size of the cell types (see above formula).

2. "Isopycnic Centrifugation"

In this case, a density gradient is introduced which also includes ranges of the same specific density as that of the cells. If a cell type reaches the gradient range which is "isopycnic" to it, its sedimentation rate approaches zero (see above formula) and cells of different specific weights then separate within the gradient, provided the gradient profile in the centrifuge vessel has a suitable spatial characteristic. Depending on the separation task, it is better to load linear or convex or concave gradients.

DE-OS 34 04 236 discloses the design of a rotor which is suitable for such cell separation, permitting the use of the aforementioned centrifugation methods in that the interior of the separation vessel remains accessible during the entire centrifugation period and that the gradient can be aspirated via a corresponding cannula. An additional advantage is that the entire rotor can be autoclaved, thus providing the conditions for a sterile (aseptic) process and, possibly, a subsequent long-term cultivation of the separated cells in the tissue laboratory.

Many years of experience with this rotor have shown design characteristics that are well worth preserving but have also revealed the following design problems and limitations:

a) Coriolis forces exist within the centrifuge vessel as shown in FIG. 1. A particle within the rotating (arrow 4) centrifuge vessel 1 would move along intended line 2 if said Coriolis force is not taken into account. In effect, however, this force acts on the particle such as to cause it to move along line 2. As a result, cell bands 6, 8 separated in gradient 7 are shaped or deformed as shown in FIG. 2. Fractionating these cell bands, 6, 8 via the tip of a cannula 5 terminating at the end of centrifuge vessel 1 causes partial smudging of the cell separation. The full separation capacity of the unit is therefore ultimately not usable because parts of band 6 continue to be eluted when band 8 has already arrived at the tip.

b) The cannula arrangement permits fractionation of the separated bands only by means of suction. While the centrifuge is running, the required suction must exceed the centrifugal force. Since this force must be as high as possible to prevent vortexing of the separated cells, the vacuum required for sucking off the cells must be so considerable that it may cause partial "degassing" of physically dissolved physiological gases (oxygen, carbon dioxide, nitrogen) in the cell's interior which can be associated with cell damage. Furthermore, for practical reasons it is rarely possible to achieve continuous elution. The use of peristaltic pumps for the continuous removal of cells would in any case be deleterious to almost all cell types. In addition, there is the constant danger of vortexing if, during the removal from the cannula entry of the syringes that are frequently used for aspirating the gradient, the volume remaining in the cannula is thrown back into the tip of the centrifuge glass.

SUMMARY OF THE INVENTION

The objective of the present invention is therefore to provide a centrifugation method which achieves optimum sharpness of separation and prevents damage during particle fractionation.

In addition, the invention advantageously creates a completely new centrifugation method by combining the two above described basic centrifugation techniques and providing the option of adding a liquid stream for continuous expression of the gradient (containing the separated sample components="bands").

The adverse influence of Coriolis forces is minimized by a continuously conical centrifuge vessel. In glass vessels, the interior is treated with a water-repellent coating, for example, with silicon in standard manner. For plastic containers, it is recommended that Teflon or polycarbonate be used as the wall material. The interior water-repellent wall coatings tend to repel the hydrophilic cells and prevent their direct wall contact.

A double cannula which can be made air tight and which has a vertical axis extending exactly through the rotor center advantageously permits the introduction of a central cannula, as with the known rotor type, but creates in addition a second gas and liquid tight access to the separation vessel. At the end of the separation process, a pressure medium can be introduced via this path to expel the gradient via the central cannula and fractionate it by means of a fraction collector which also forms part of the optimum equipment of this centrifuge unit. This fractionation technique permits complete preservation of the band pattern within the conical, continuously tapering centrifuge vessel during the course of the gradient expulsion which is supported by nearly punctiform removal. The well separated sample components are simultaneously collected and isolated by means of a fraction collector.

Finally, the centrifugation method according to the invention simultaneously brings into play for the separation process several typical cell parameters to provide an unsurpassable sharpness of separation. First, the sample is introduced into the centrifuge vessel via the inner central cannula. With gradient medium, this sample is advantageously brought to a specific density that is just above the lightest cell type in the mixture. As a result, during continued centrifugation, this cell type rises in pure form as the top band.

A further basic requirement for optimizing the centrifugation method according to the invention is the use of both an electronically controlled, stepless pump unit and centrifuge unit in combination with the newly developed rotor, so that the two apparatuses can be coordinated by programming.

As the—computer-controlled—pumping of the gradient is started, such gradient usually consisting of a mixture of two solutions, two forces simultaneously act on the cell mixture to be separated: the centrifugal force and the stream force. At this stage of centrifugation, the former primarily leads to cell separation based on the different diameters and specific density of the cells, the latter primarily catches oddly shaped cells or aggregates while compactly formed and heavy individual cells are hardly influenced. Furthermore, the direction of cell migration can be specifically influenced by rapidly changing the osmolarity of the gradient medium by admixing corresponding salt concentrations via the program (erythrocytes, for example, shrink rapidly in hypertonic media to obtain a greater specific weight which causes them to sediment more rapidly). Program control furthermore permits rapid introduction of density gradient ranges which are so high that certain cell types of the initial sample reach a density range which for them is isopycnic and then stay in accordance with the aforementioned formula. Other cell types may continue to migrate under the respective prevailing conditions and collect only in gradient ranges that arc further removed from the centrifuge axis. The pump unit speed and the centrifuge rotation rate can be adapted to any cell mixture, thus permitting cell separation with heretofore unachieved sharpness within a very short time (partly within a few minutes). This can be decisive for the vitality of biological preparations. In addition, the described method is extremely versatile and relatively inexpensive.

BRIEF DESCRIPTION OF THE DRAWINGS

Below, the invention and its embodiments are further illustrated by means of the figures.

DETAILED DESCRIPTION OF THE PREFERRED EMBODIMENT

Figure 3:
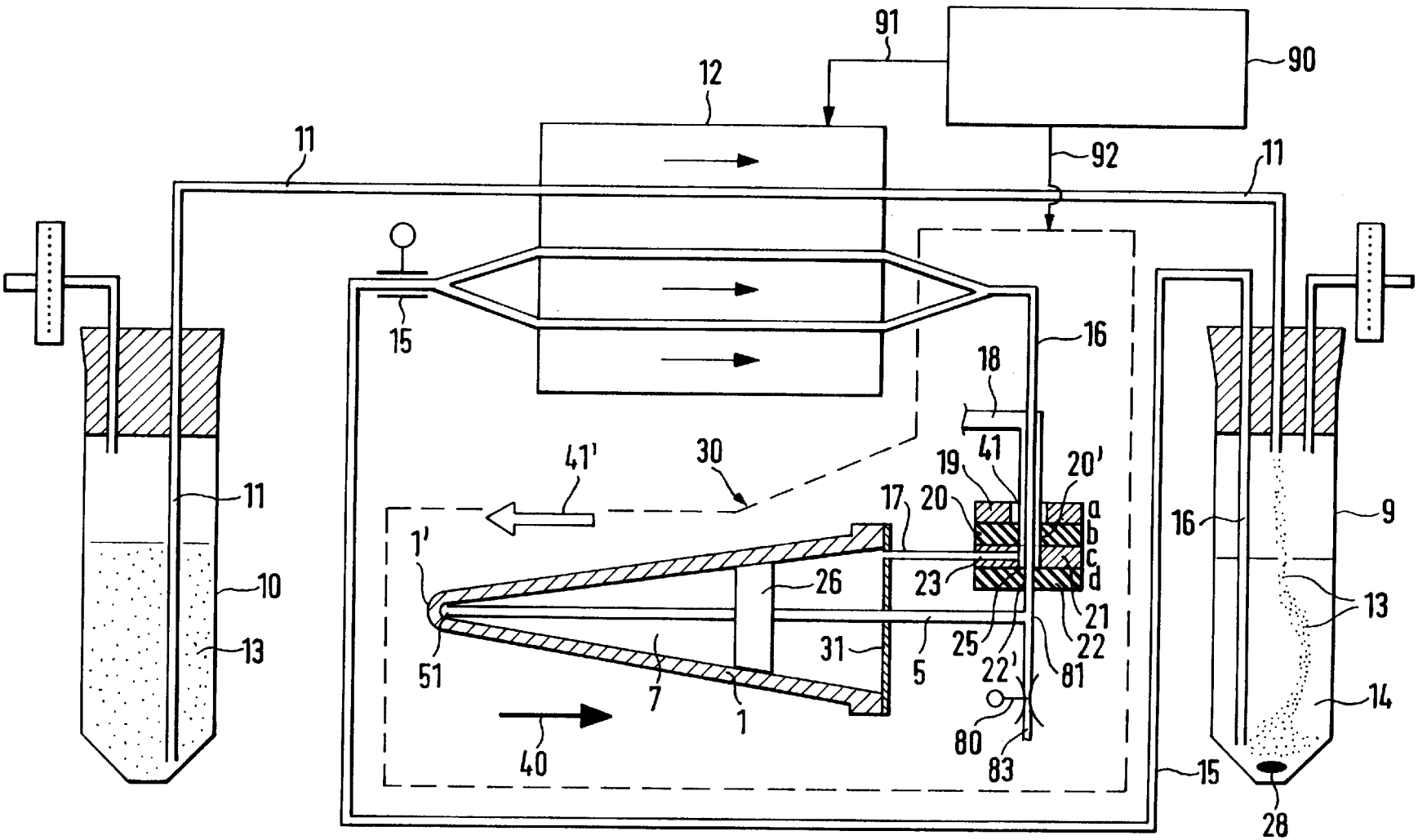
Figure 4:
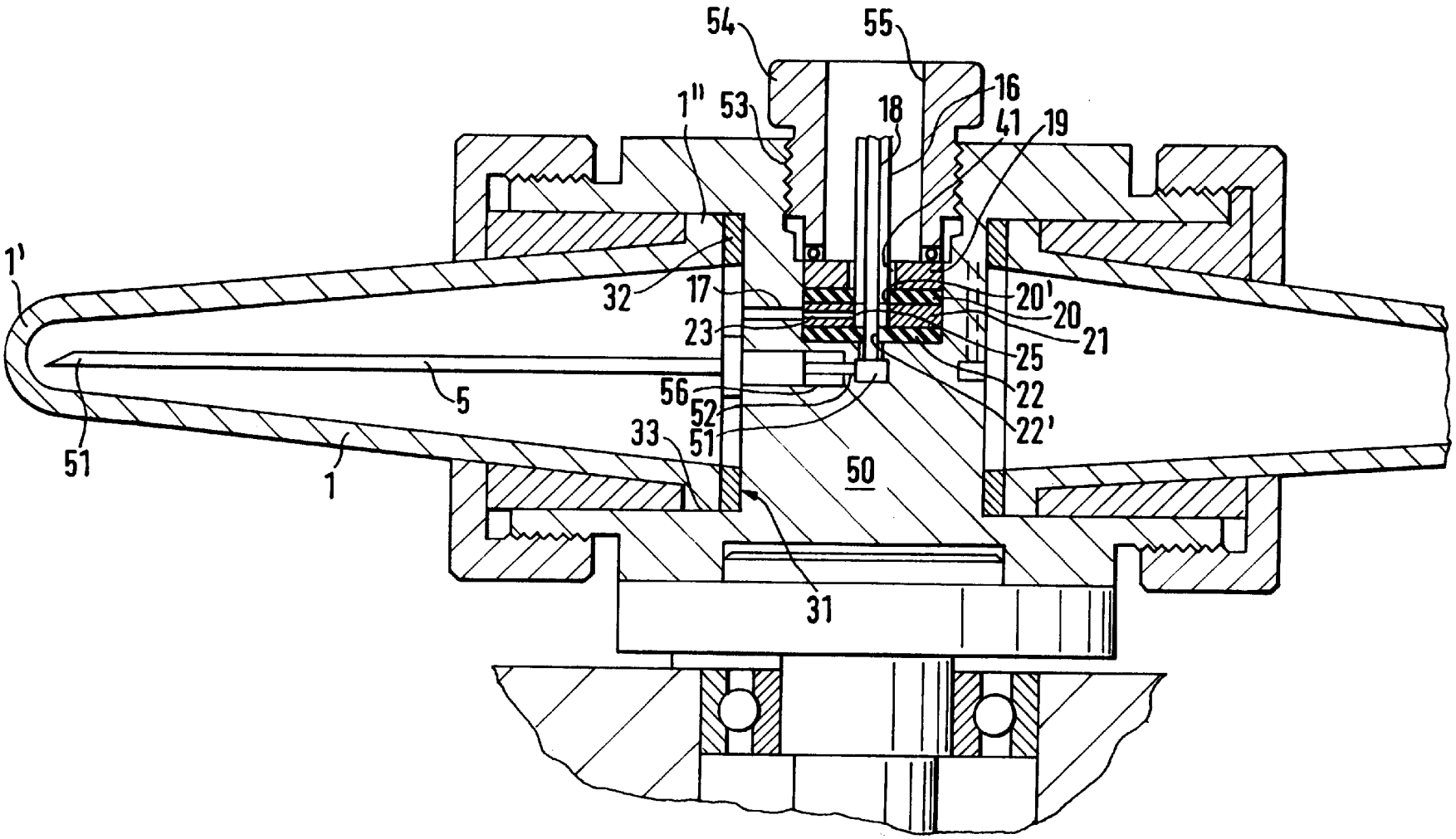
FIG. 4 is a cross-sectional side view of the centrifuge including a rotor and line arrangement according to the invention.

FIG. 3 shows a device for carrying out the present method. This device essentially comprises a first vessel 10 for a denser gradient solution, a second vessel 9 for a comparatively thinner gradient solution, a pump unit 12, a centrifuge unit 30, which will be further illustrated below, and a computer unit 90. Centrifuge unit 30 holds and rotates centrifuge vessel 1, the shape of which is tapering or conical as shown in FIG. 3 to minimize the action of Coriolis forces. The special conical form furthermore enhances the separation of the fractions in the area of the tip 51 of central cannula 5 because the individual fractions are drawn apart in the area of the small diameter at tip 51. Central cannula 5 extending along the axis of centrifuge vessel 1 projects into the interior of centrifuge vessel 1 such that its free end 51 terminates immediately in front of tip 1' of conical centrifuge vessel 1. The entire end 51 is preferably made in the form of a point as shown in FIG. 4. Furthermore, an additional cannula 17 projects into centrifuge vessel I at a point other than its longitudinal axis and terminates approximately at the end of centrifuge vessel I which is closed off by a cover part 31.

Computer unit 90 is connected, respectively, with pump unit 12 and centrifuge unit 30 via connections 91 and 92 so that these units are controllable by a program stored in computer unit 90 with respect to the volume of delivery and the rotational speed.

The described unit is used as follows:

In a first step, a gradient solution of a desired density is prepared. For this purpose, a denser gradient solution 13 is transferred in a precisely programmed manner controlled by computer unit 90 from first vessel 10 via line 11 by means of pump unit 12 to second vessel 9 holding a thinner gradient solution 14. Advantageously, the introduced denser gradient solution 13 and the thinner gradient solution 14 in vessel 9 arc continuously mixed by means of a magnetic stirrer 28 to obtain a continuous change of density. After hose clamp 15 or some other closing device is opened, mixed gradient solution 7 of the desired density is introduced into the interior of centrifuge vessel 1 in the area of tip 1' of such vessel via central cannula 5 by means of pump unit 12. At this time, vessel I in the area of tip 1' already contains sample 26 to be fractionated since the gradient is introduced after sample 26. As gradient solution 7 is introduced, sample 26 is displaced in the direction of arrow 40 against centrifugal force 41 so that the cell particles of sample 26 migrate into gradient solution 7. Gradient solution 7 can be computer-controlled with respect to its density such that the density increases continuously or by steps to a precisely predetermined degree.

As a result, fractionation is achieved by means of the processes taking place during centrifugation, equilibrium centrifugation, in which the particles of sample 26 continue to migrate until they reach their corresponding gradient density, and sedimentation centrifugation, in which the cell particles of sample 26 are separated into different parallel particle zones (bands) based on their form and/or size and/or aggregation.

Figure 1:
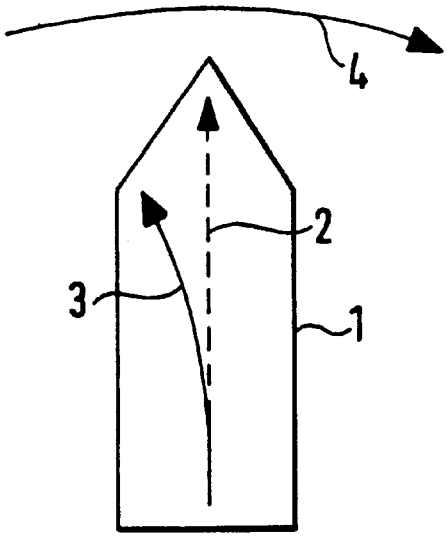
FIG.1 (PRIOR ART)
FIG. 1 and 2 show representations illustrating the principle of a prior art centrifugation method according to the invention and FIG. 3 is a schematic flowchart of an apparatus and method for centrifugal separation according to the invention.
Figure 2:
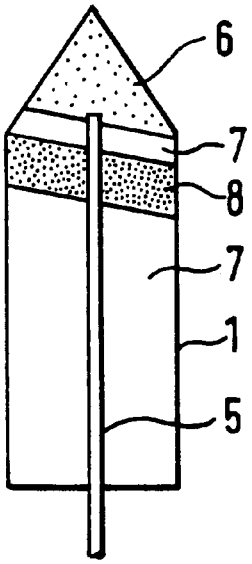
FIG.2 (PRIOR ART)

As previously mentioned, the conical shape of centrifuge vessel 1 prevents the fractions formed in accordance with FIG. 2 from being smudged by the Coriolis force since the effects of such force are irrelevant with the small vessel diameters obtained by the taper.

The possibility of adding a solution gradient 7 that is programmably controlled with respect to its increasing density by determining the mixture ratio within vessel 9 through control of pump unit 12 as well as the rotational speed of centrifuge unit 30 permits a degree of control of the fraction separation that has never before been achieved.

After separation, a pressure medium, preferably saline, is introduced into the interior of centrifuge vessel 1 via line 18 and cannula 17 for the removal of the produced fractions via central cannula 5. Through the pressure produced in the interior of centrifuge vessel 1 and against centrifugal force 41, these fractions are aspirated in punctiform manner via tip 51 of central cannula 5 (preferably at reduced rotational speed) and removed with a previously unobtainable degree of sharpness. Central cannula 5 preferably branches via a T-type connector 81 to a hose clamp 80 or another closing device which is then opened such that the fractions can be removed via line 83.

The following further illustrates the design of the rotor of centrifuge unit 30 with respect to the preferred line arrangement of central cannula 5 and additional cannula 17 in accordance with FIG. 4. The body of this rotor to which centrifuge vessel 1 is fixed is identified as 50.

Feed line 18 for central cannula 5 and feed line 16 for additional cannula 17 are preferably arranged coaxially to each other in the form of a double cannula. The two lines 16 and 18, with line 18 being inside line 16, first extend through an upper plate 19 in the center of which there is a borehole 41, through which said double cannula extends. Below plate 19, which is preferably made of steel, is a gasket 20 for outer line 16, which is preferably made of silicone rubber. The end of line 16 terminates in a central borehole 20' of gasket 20. Below gasket 20, there is an additional plate 21, preferably made of steel, through borehole 25 of which inner line 18 extends. The end of line 16 which is sealed by gasket 20 is therefore tightly connected with borehole 25 which in turn is connected with cannula 17 via passageway 23 extending radially within plate 21. Line 18 extending through borehole 25 extends through a central borehole 22' of an additional gasket 22, which is preferably also made of silicon rubber, and seals line 18 along its outer circumference. Gasket 22 is preferably made of a softer silicon rubber than gasket 20. The end of line 16 projects into a borehole 51 made in body 50 of the rotor of centrifuge unit 30, which borehole is radially connected with central cannula 5 via passageway 52. Said plates 19 and 21 and said gaskets 20 and 22 are pressed against each other by screw 54 which is screwed into a borehole 53 of body 50, with said lines 16 and 18 extending outward through axial borehole 55 of screw 54. During operation of centrifuge unit 30, body 50, screw 54, plates 19 and 21 and gaskets 20 and 22 rotate while lines 16 and 18 are non-rotating parts which are supported by ball bearings (not shown) in relation to the rotating parts.

It has been shown that silicon rubber is a particularly advantageous material for said gaskets 20 and 22 because the wear caused along the outer circumferences of lines 16 and 18 during rotation of centrifuge unit 30 is minimal. Worn silicon rubber gaskets 20 and 22 can be very easily replaced by loosening screw 54 and removing plates 19 and 21.

Different central cannulas 5 are preferably connectable to passageway 52 by means of a scaled screwed connection 56.

The non-rotating double cannula 16, 18 can advantageously be removed while centrifuge unit 30 is running. This makes it possible to achieve extremely high rotational speeds without gasket wear. These speeds permit fractionation of even sub-cellular particles. The double cannula is reinserted for the later removal of the gradient at lower speeds.

The aforementioned cover part 31 of centrifuge vessel 1 can be realized by pressing vessel rim 1" against a sealing ring 32 which sits in a recess 33 of rotor body 50. In this case, the passageway of rotor body 50 forming additional cannula 17 leads to the bottom of recess 33 within sealing ring 32 and central cannula 5 is fixed to rotor body 50 by means of the aforementioned screwed connection 56.

Centrifuge vessel 1 preferably measures approximately 10 to 15 cm in length from its tip 1' to its opening while the opening measures approximately 3 to 8 cm in diameter.

The following shows how all these parameters are combined, in comparison with conventional centrifuge systems, and how they can be optimized to isolate neutrophilic granulocytes of the blood of the guinea pig (for which there are no commercially available antibodies that can be used in immunological separation techniques). As is generally known, these neutrophilic granulocytes are nucleus-containing cells in the blood which—in addition to other nucleus-containing cells (other granulocytes, lymphocytes, monocytes)—belong to the "white blood cells" or "leukocytes." All the leukocytes combined make up only approximately 0.1–0.2% of all blood cells, the neutrophilic granulocytes a mere 0.03–0.09%. Besides thrombocytes (approximately 4% of all blood cells), blood primarily consists of red blood cells (approximately 96%). Thus, purification of granulocytes by centrifugation represents an extreme example which is made all the more difficult by the fact that erythrocytes are the heaviest blood cells. As a result they migrate the farhest into the density gradients and must consequently be eluted as the first (completely overloaded) band.

The second example is to illustrate that this separation efficiency by means of centrifuge techniques can also be used for cell mixtures which must first be dissociated from their native organs by sophisticated proteolytic procedures. In this concrete example, the difficult task consists of completely separating the microvessels and their connective tissue cells, which in the heart muscle are extremely numerous and multidisperse, from the heart muscle cells (cardiomyocytes). Cardiomyocytes have a cell-specific metabolism that can only be correctly investigated if these cells are completely purified. This task, which is important in cardiology for pharmacological purposes, is made all the more difficult due to the extreme responsiveness of heart muscle cells to various stimuli: once these cells hypercontract, they die.

I claim:

1. A method for centrifugal particle separation in the biological sector, comprising the steps of introducing a sample to be fractionated into a centrifuge vessel via a first cannula having a free end which extends to a tip of a centrifuge vessel which is tapered toward the tip to minimize undesired effects of Coriolis force, introducing a gradient solution having an increasing density via the first cannula such that particles from the sample migrate into said gradient solution, and introducing a pressure fluid into the centrifuge vessel via a second cannula to drive out gradient solution containing fractionated particle components of the sample via the first cannula.

2. The method according to claim 1, wherein the gradient solution is mixed from at least a first solution and a second solution, the second solution having a comparatively lower density than the first solution, to achieve a desired density for the gradient solution.

3. The method according to claim 2, wherein the first solution is taken from a first vessel and transferred by a pump unit to a second vessel which contains the second solution, wherein the first and second solutions contained in the second vessel are continuously intermixed and are transferred from the second vessel to the first cannula by the pump unit.

4. The method according to claim 3, wherein the pump unit is continuously controlled by a computer unit in order to continuously obtain the desired density of the gradient solution.

5. The method according to claim 3, wherein feed of gradient solution is controlled by the pump unit via a computer unit through predetermined changes in feed rates.

6. The method according to claim 1, wherein a centrifuge vessel is used with the first cannula extending centrally within centrifuge vessel.

7. The method according to claim 1, wherein the centrifuge vessel is used with the second cannula extending at a position outside a central longitudinal axis of the centrifuge vessel.

* * * * *